US005486236A

United States Patent [19]

Townsend et al.

[11] Patent Number: 5,486,236

[45] Date of Patent: Jan. 23, 1996

[54] ACCELERATED EXTRACTION OF ROLLED MATERIALS

[75] Inventors: Carl W. Townsend; Edna M. Purer, both of Los Angeles, Calif.

[73] Assignee: Hughes Aircraft Company, Los Angeles, Calif.

[21] Appl. No.: 239,057

[22] Filed: May 6, 1994

[51] Int. Cl.[6] ..... B08B 1/02; B08B 1/04; B08B 3/10; B08B 3/12

[52] U.S. Cl. ..... 134/13; 134/1; 134/10; 134/14; 134/15; 134/32

[58] Field of Search ..... 134/1, 2, 3, 9, 134/15, 10, 11, 12, 13, 14

[56] References Cited

U.S. PATENT DOCUMENTS

| | | | |
|---|---|---|---|
| 3,370,982 | 2/1968 | Hayunga | 134/9 |
| 3,559,301 | 2/1971 | Fraser | 34/156 |
| 3,615,814 | 10/1971 | Ott et al. | 134/1 |
| 3,635,762 | 1/1972 | Ott et al. | 134/1 |
| 3,737,941 | 6/1973 | Miller et al. | 15/100 |
| 4,944,837 | 7/1990 | Nishikawa et al. | 156/646 |
| 5,013,366 | 5/1991 | Jackson et al. | 134/1 |
| 5,213,619 | 5/1993 | Jackson et al. | 134/1 |

*Primary Examiner*—Jan H. Silbaugh
*Assistant Examiner*—Robin S. Gray
*Attorney, Agent, or Firm*—M. E. Lachman; M. W. Sales; W. K. Denson-Low

[57] ABSTRACT

Undesired constituents are removed from rolled fabric or other rolled materials by: (a) placing a roll of the material containing the undesired constituents (soluble or particulate) in a cleaning chamber; (b) providing a structure for re-rolling the material within the chamber; (c) introducing into the cleaning chamber a cleaning fluid which is a dense phase fluid comprising a liquefied gas or a supercritical fluid and contacting the material containing the undesirable constituents with the cleaning fluid; and (d) exposing single layers of the material containing the undesirable constituents with the cleaning fluid for a period of time sufficient to remove the undesired constituents from the material.

12 Claims, 3 Drawing Sheets

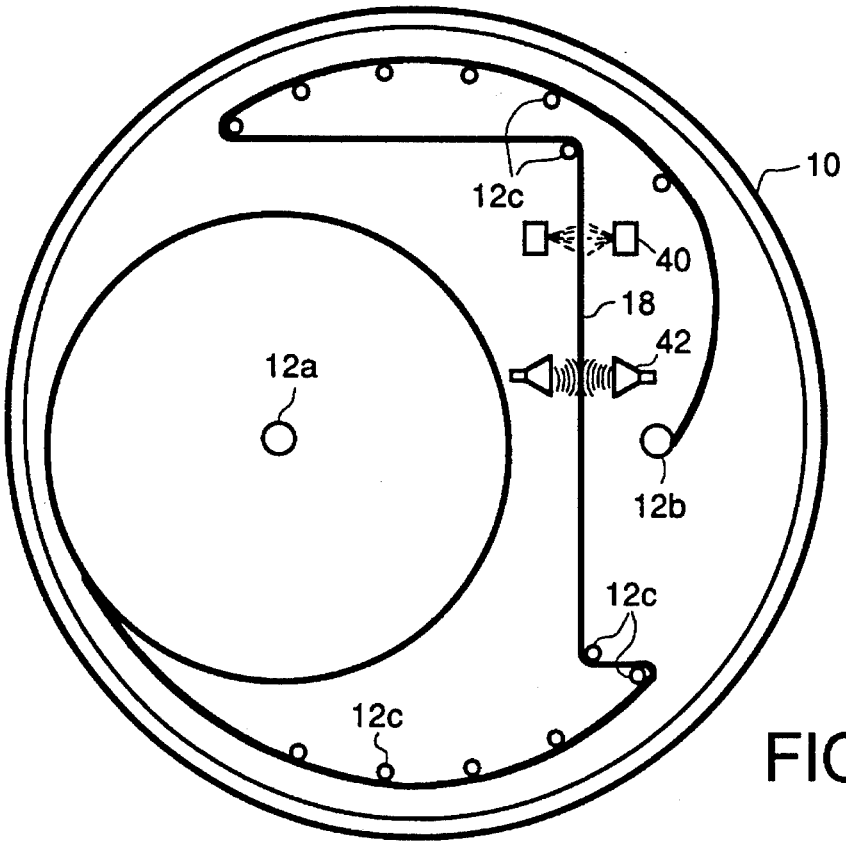
FIG. 3.
FIG. 4.
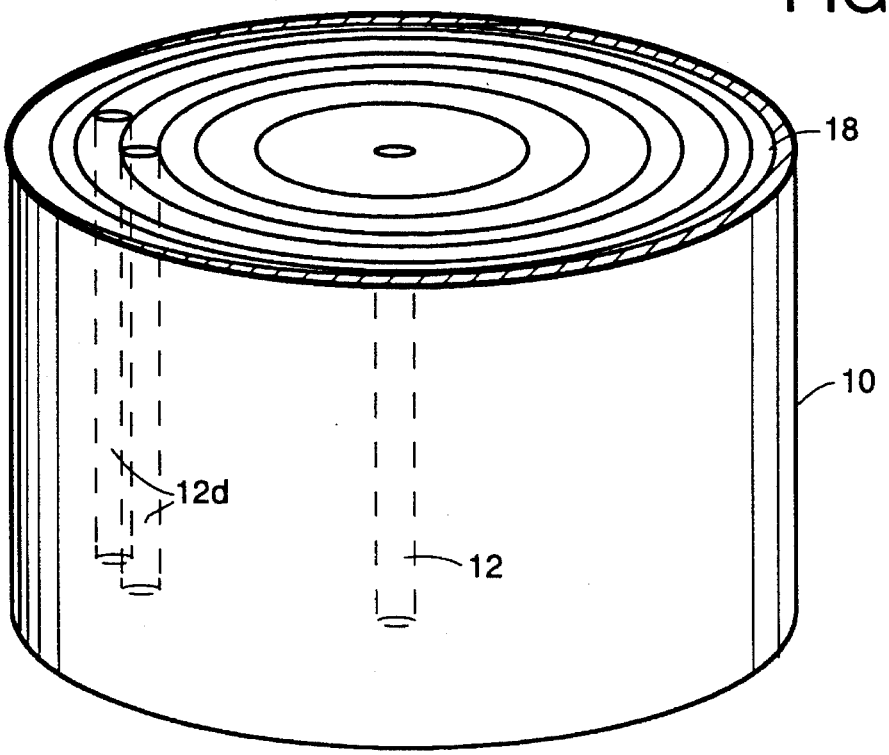

ACCELERATED EXTRACTION OF ROLLED MATERIALS

BACKGROUND OF THE INVENTION

1. Field of the Invention

The present invention is related generally to removal of contaminants or other undesirable constituents from rolled materials, such as fabrics, and, more particularly, to greatly accelerating the rate at which such contaminants or undesirable constituents may be cleaned from such parts by continuous exposure to high pressure cleaning fluids during rolling to expose single layers of material to the cleaning fluid to dissolve and carry away residual contaminants and entrain and carry away particulates.

2. Description of Related Art

Many thin material products, such as fabrics, paper, separator or filtration membranes, are handled by rolling a long strip into a roll. Materials in the form of a thread, tube, or wire are also handled in the same fashion. Usually, as part of the manufacturing process, one or several undesirable components must be removed from the material through a cleaning and extraction process. These components may be processing aids, such as lubricants, unreacted monomer, or sacrificial pore precursors, as would be found in some types of separator materials. A variety of cleaning and extraction processes are used for removing these components. Most of these cleaning and extraction processes use ozone-depleting, toxic, or flammable chemicals, thus creating a disposal problem both for the extracted component and the extraction medium.

In current supercritical cleaning and extraction processes used for fabrics, a roll of material is placed in the pressure chamber and processed in its stationary state. This technique generally requires long extraction times, due to the long diffusion path length found in large spiral-wound rolls of fabric. Extraction times exceeding eight hours are typical for 10 to 14 inch (25.4 to 35.6 cm) diameter rolls. As a result, system throughput is low and processing costs high.

Thus, there remains a need to provide an improved method for removing contaminants or undesirable constituents from rolls of fabric or other rolled material that avoids or minimizes the above mentioned disadvantage.

SUMMARY OF THE INVENTION

In accordance with the present invention, an improved process is provided for removing undesired constituents from a chosen material, comprising the steps of:

(a) placing a roll of the material containing the undesired constituents in a cleaning chamber;

(b) providing a means for re-rolling the material within the chamber;

(c) introducing into the cleaning chamber a cleaning fluid comprising a dense phase fluid (liquefied or supercritical gas) and contacting the material containing the undesirable constituents with the cleaning fluid; and (d) re-rolling the material to expose single layers of the material containing the undesirable constituents with the cleaning fluid for a period of time sufficient to remove the undesired constituents from the material.

The undesired constituents may comprise soluble contaminants and/or insoluble particulates.

Also in accordance with the present invention, an apparatus for removing undesired constituents from a chosen material is provided, comprising:

(a) a chamber for containing the cleaning fluid and the roll of the material containing the undesired constituents;

(b) means for rerolling the material within the chamber;

(c) pressure control means connected to the chamber for controlling the pressure of the cleaning fluid within the chamber;

(d) temperature control means connected to the chamber for controlling the temperature of the cleaning fluid within the chamber;

(e) inlet means in the chamber for introducing the cleaning fluid into the chamber; and (f) outlet means in the chamber for removing the cleaning fluid from the chamber.

The present invention thus improves upon the prior art by combining the high cleaning rates found in the conventional dynamic cleaning processes with the environmental advantages afforded by liquefied gas or supercritical fluid cleaning and extraction processes.

BRIEF DESCRIPTION OF THE DRAWINGS

FIG. 3 illustrates a top plan view of the apparatus of FIG. 2 showing one possible roller path; and FIG. 4 illustrates a perspective view of a further embodiment of the present invention having a single take-up roller.

DESCRIPTION OF THE PREFERRED EMBODIMENTS

Figure 1:
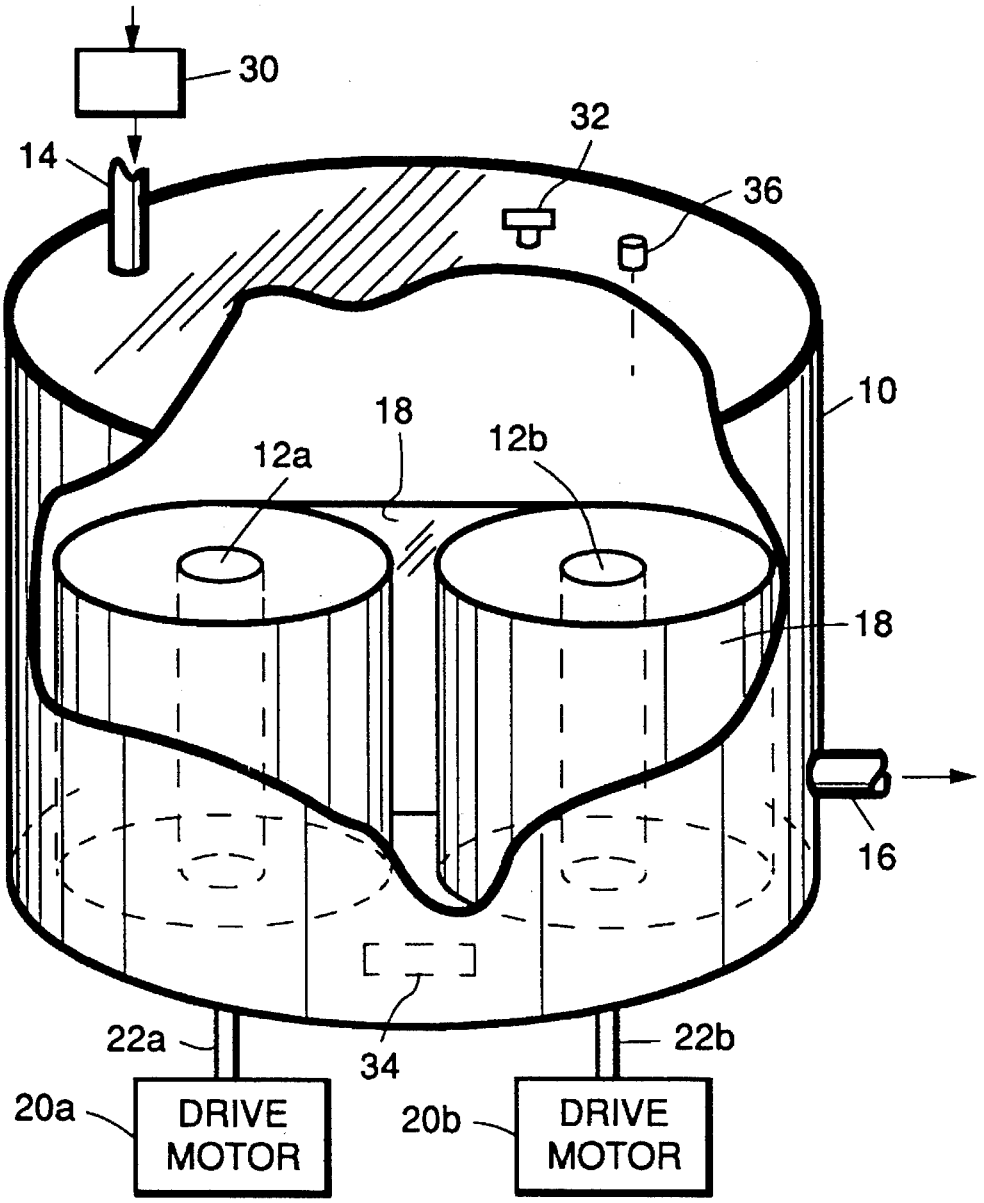
FIG. 1 illustrates a perspective view of a pressure vessel employing two rollers used in the practice of the present invention.

The present invention describes a method for greatly accelerating the rate at which contaminants or undesirable constituents may be cleaned from rolls of fabric or other rolled material. This invention re-rolls the material inside a processing vessel, thereby continuously exposing single layers of material to high-pressure dense phase gas as cleaning fluids (liquefied or supercritical gas).

The dense phase gas used in the practice of the present invention is chosen to be a gas which can be liquefied under moderate conditions of temperatures and pressure. For example, carbon dioxide, an example of a gas preferably employed in the practice of the present invention, may be liquefied at a pressure from as low as 600 pounds per square inch (42.2 Kg/cm$^2$) and at ambient temperatures within the range of about 10° to 30° C. Higher than critical pressures may be employed in the practice of the present invention so long as the temperature is maintained below 32° C.

In addition, for practical purposes, it is desirable that the gas is also non-toxic, non-flammable, and does not cause any damage to the environment. Gases which are suitable for practicing the present invention include, but are not limited to, carbon dioxide, nitrous oxide, sulfur hexafluoride, and xenon, with carbon dioxide being most preferred. In the following discussions, carbon dioxide is used as an example of one gas which may be used in practicing the present invention, but it is to be understood that the invention is not so limited.

Carbon dioxide is an unlimited, inexpensive, nontoxic, and easily liquefiable natural resource. In the dense phase state (liquid or supercritical), it offers a good, low viscosity cleaning fluid at the relatively low pressures and mild temperatures indicated above.

The liquefied gas may be used with modifiers. Typically a small percentage (less than about 50 vol/vol percent) of a condensed phase solvent, or modifier, is added to the bulk compressed gas. These modifiers are mixed with the compressed gas to form a non-flammable, non-toxic mixture. The modifiers change the chemical properties of the condensed gas to improve the solubility properties of the mixture. The modifier or modifiers used depend on the contaminant being removed. For removing polar organic contaminants, a solvent such as iso-propanol or acetone is employed. For removing polar inorganic contaminants, water is desirably employed. For removing low molecular weight non-polar organic ($C_6$ to $C_{18}$) contaminants, a solvent such as hexane may be used. For removing high molecular weight non-polar organic ($>C_{18}$) contaminants, a solvent such as kerosene may be used.

Alternatively, supercritical fluids may be used as extraction and cleaning mediums in order to minimize or eliminate the use of ozone-depleting and hazardous chemicals. Upon decompression from the supercritical (or liquid) to gaseous state, carbon dioxide loses its solvent properties and the extracted, solvated materials drop out in a concentrated form, allowing either reuse or simplified disposal of the carbon dioxide.

Supercritical carbon dioxide is formed at pressures exceeding 75.3 $Kg/cm^2$ and at temperatures exceeding 32° C. Preferably, the pressure ranges from about 1,500 to 4,500 pounds per square inch (105.4 to 316.4 $Kg/cm^2$) and the temperature ranges from greater than 32° C. to a maximum of about 100° C.

Other supercritical fluids which may be used in the practice of the present invention include nitrous oxide, sulfur hexafluoride, and xenon.

During cleaning and extraction of contaminants from rolled fabric and other materials, the rolled material is placed in the pressure vessel. The chamber is pressurized to the appropriate process conditions (liquefied gas or supercritical fluid), the rolled material is unrolled and re-rolled onto a separate roller, and the contaminants and undesirable constituents are dissolved and carried away, either in a flow-through mode or in batch processing. Particulates on the material which can be entrained by the dense phase fluid (liquefied or supercritical gas) are also carried away. The processing of the present invention leads to substantially even exposure of the rolled material to the cleaning medium.

FIG. 1 illustrates the most basic form of the invention. A pressure vessel 10 is provided, having two rollers 12*a* and 12*b* and inlet port means 14 and outlet port means 16 for supplying dense phase fluid in a flow-through mode. The roll of material 18 to be processed is placed on a first roller 12*a*. The end of the material 18 is attached to a second roller 12*b*. A drive motor 20*b* rotates the second roller 12*b*, pulling material 18 from the first roll 12*a* through the dense phase fluid, and rolls it onto the second roller 12*b*. The motors 20*a* and 20*b* are coupled to the rollers 12*a* and 12*b* by means of a drive shaft 22.

The speed of the motor 20 is adjusted so that the contaminant and extractable level in the material 18 has been reduced to its target level by the time it reaches the second roller 12*b*. Once the entire roll of material 18 has reached the second roller 12*b*, the vessel 10 is depressurized and the material 18 removed. Alternately, if the required level of contamination is lower than can be attained during a single pass of the material 18, the direction of rotation can be reversed and a second pass performed. Besides greatly reduced processing times, an additional advantage to this method is the uniform exposure of the material to the extracting medium, leading to a more uniform product. Since the cost of a pressure vessel 10 depends strongly on its size, it is advantageous to maximize the size of the roll of material 18 which can be placed in the vessel 10.

As seen in FIG. 1, two drive motors 20*a* and 20*b* are employed. These function much like a cassette player, being ganged together, with one motor driving when winding in one direction and the other motor driving when winding in the opposite direction. The non-driving motor is in an idle mode.

Pressure control means, such as a compressor 30 and pressure gauge 32, and temperature control means, such as a heater/cooler 34 and thermocouple 36, shown schematically in FIG. 1, may be used to control pressure and temperature, respectively. Such pressure control and temperature control means are well-known in the art.

Figure 2:
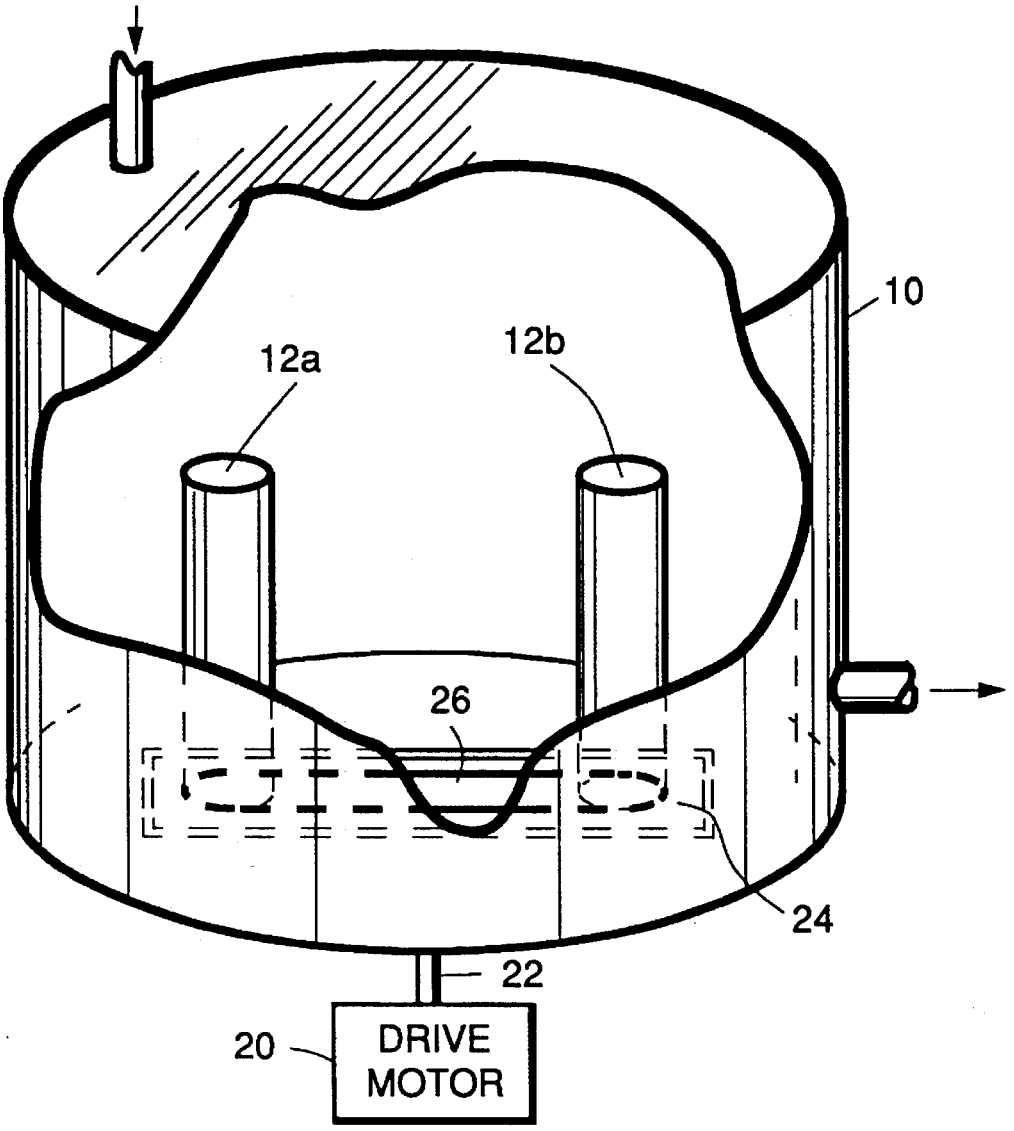
FIG. 2 illustrates a perspective view of an alternative embodiment of the present invention showing a roller apparatus for accommodating the largest possible roll within the pressure vessel.

FIG. 2 shows a roller apparatus which will accommodate the largest possible roll of material. Since two partially filled rolls of material occupy more space than a single roll of material, the vessel 10 must have a diameter which is twice the diameter of two half-filled rolls of material. Geometric analysis shows that the diameter of the filled roll of material will be approximately 1.41 times that of one half-filled roll of material. This requires that the rollers 12*a* and 12*b* must be free to move from side-to-side as the material is rolled from one side to the other. This is achieved by use of a sliding track 24 on which the rollers 12*a* and 12*b* move from side-to-side. A belt 26 couples the two rollers 12*a* and 12*b* together and is driven by the drive shaft 22. Further geometric analysis shows that the rollers 12 must be able to move from a maximum distance of approximately 0.707 times the vessel radius, to a minimum distance of approximately 0.293 times the vessel radius. For convenience, the rollers 12*a* and 12*b* may be attached to each other, at a spacing of one vessel radius. If the thickness of the material is significant, or the solubility of the contaminant low, it is advantageous to increase the path length between the two take-up rollers. This will allow more exposure time of single layer material to the dense phase fluid extractant. Alternately, the speed of the motor 20 can be decreased, further reducing processing time.

FIG. 3 shows one possible roller path which does not significantly increase the required vessel 10 diameter. The intermediate rollers 12*c* must also be free to move from side-to-side as the material is rolled from one take-up roller 12*b* to the other. Other path configurations with substantially longer path lengths may be constructed if the faster extraction rates warrant the additional complexity and larger vessel sizes.

FIG. 3 illustrates use of directed jets 40, which direct a jet of cleaning fluid onto the material 18. FIG. 3 further illustrates the alternate embodiment of exposing the material 18 to ultrasonic agitation, using ultrasonic transducers 42.

FIG. 4 shows another embodiment of the invention in which a single take-up roller 12 is used. The material 18 is fed between two roller fingers 12*d* which pull the material 18 to the outer wall of the vessel 10, on each revolution, essentially loosening the roll and creating a small gap between individual layers. This loose wrap facilitates cleaning fluid flow between layers, thus minimizing processing time. At the end of the cycle, the material 18 is rewound on the central roller 12. Rewinding can be conducted during decompression, further reducing cycle time.

At the end of the cleaning cycle, the chamber is decompressed for removal of the sample, or, the cleaning step can be repeated as required.

Further, a closed loop, recirculating liquid $CO_2$ regenerating system may be employed, in which the removed contamination can be readily separated from the cleaning medium. This can be accomplished either by decompression, filtration, or a combination of both. By the decompression of the dense phase $CO_2$ (liquid or supercritical), gaseous $CO_2$ is formed and the contaminants separate out in a concentrated form that allows for easy disposal. The clean gaseous $CO_2$ remaining is then recompressed to the liquid state and is then recirculated to the cleaning chamber 10. To accomplish this process, the dense phase liquid containing the contaminants is transported out of the chamber 10 through outlet port 16 to separator (not shown). In the separator, the contaminated dense phase fluid is decompressed and/or filtered as indicated above. The clean $CO_2$ is then transported by tubing (not shown) into chamber 10 through inlet port 14.

A long immersion and processing time is usually required in conventional processes to remove contaminants and extractables from the rolled material surfaces. The extended processing reduces system throughput, thereby reducing the practicality of the process. However, the present invention combines the high cleaning rates found in the conventional dynamic cleaning processes where the parts are in motion to facilitate exposure with the environmental advantages afforded by dense phase fluid cleaning and extraction processes. The present process can accomplish cleaning of rolled materials in very short times, such as at least about 10 minutes. The present process also allows for the removal of particulates that would otherwise be trapped in the material. In an alternate embodiment, means for maximizing particulate removal may be employed. For example, a directed flow jet of dense phase fluid, ultrasonics, or transducers may be utilized for particulate removal.

Thus, there has been disclosed an improved method and apparatus for greatly accelerating the rate at which contaminants or undesirable constituents may be cleaned from rolls of fabric or other rolled material. It will be readily apparent to those of ordinary skill in this art that various changes and modifications of an obvious nature may be made, and all such changes and modifications are considered to fall within the scope of the invention, as defined by the appended claims.

What is claimed is:

1. A process for removing undesired constituents from a chosen material, comprising the steps of:

(a) placing a first roll comprising multiple single layers of said material containing said undesired constituents in a cleaning chamber for containing cleaning fluid wherein cleaning takes place;

(b) providing a means for unrolling said material from said first roll and re-rolling said material onto a second roll, wherein said first and second rolls are located within said cleaning chamber;

(c) introducing into said cleaning chamber said cleaning fluid comprising either a liquefied gas or a supercritical fluid and contacting said first roll of said material containing said undesired constituents with said cleaning fluid; and (d) unrolling said material containing said undesired constituents from said first roll and re-rolling said material onto said second roll in said cleaning chamber while exposing single layers of said material containing said undesired constituents and said first and second rolls to said cleaning fluid for a period of time sufficient to remove said undesired constituents from said material and to provide cleaning fluid containing said undesired constituents.

2. The process of claim 1 wherein said undesired constituents comprise insoluble particulates and said material is exposed to ultrasonic or directed jet agitation for removal of said insoluble particulates.

3. The process of claim 1 wherein said material comprises a rolled fabric or other rolled materials.

4. The process of claim 1 wherein said cleaning fluid is selected from the group consisting of carbon dioxide, nitrous oxide, sulfur hexafluoride, and xenon.

5. The process of claim 1 wherein said cleaning fluid includes less than 50 vol/vol percent of a condensed phase solvent to form a mixture having improved solubility properties for said undesired constituents over said cleaning fluid alone.

6. The process of claim 1 further comprising the step of, following said exposing step, treating said cleaning fluid containing said undesired constituents to remove said undesired constituents and returning said treated cleaning fluid to said cleaning chamber.

7. The process of claim 6 wherein said cleaning fluid containing said undesired constituents is treated by at least one of decompression and filtration.

8. The process of claim 7 wherein said cleaning fluid is decompressed to form gas and to allow said undesired constituents to separate from said gas, and said gas is then compressed to generate said cleaning fluid.

9. The process of claim 1 wherein said liquefied gas consists essentially of carbon dioxide and has a temperature of about 10° to 30° C. and a pressure of at least 600 pounds per square inch (42.2 $Kg/cm^2$).

10. The process of claim 1 wherein said supercritical fluid consists essentially of carbon dioxide and has a temperature of at least 32° C. and a pressure of at least 1,080 pounds per square inch.

11. The process of claim 1 wherein said exposing is carried out for a period of time of at least about 10 minutes.

12. The process of claim 1 wherein the steps of re-rolling said material within said chamber and exposing said material to said cleaning fluid are repeated at least once.

* * * * *